US010400742B2

(12) United States Patent
Galfre et al.

(10) Patent No.: US 10,400,742 B2
(45) Date of Patent: Sep. 3, 2019

(54) HYDRAULIC MACHINE WITH FLOATING CYLINDERS

(71) Applicant: Merlo Group Innovation Lab S.r.l., San Defendente di Cervasca (IT)

(72) Inventors: Renato Galfre, San Defendente di Cervasca (IT); Amilcare Merlo, San Defendente di Cervasca (IT); Stefano Negrini, San Defendente di Cervasca (IT)

(73) Assignee: MERLO GALFRÉ INNOVATION LAB S.R.L.

( * ) Notice: Subject to any disclaimer, the term of this patent is extended or adjusted under 35 U.S.C. 154(b) by 158 days.

(21) Appl. No.: 15/364,501

(22) Filed: Nov. 30, 2016

(65) Prior Publication Data

US 2017/0152832 A1 Jun. 1, 2017

(30) Foreign Application Priority Data

Nov. 30, 2015 (IT) ..... 102015000078409

(51) Int. Cl.
*F03C 1/06* (2006.01)
*F03C 1/32* (2006.01)
(Continued)

(52) U.S. Cl.
CPC ..... *F03C 1/0639* (2013.01); *F03C 1/0636* (2013.01); *F03C 1/0652* (2013.01);
(Continued)

(58) Field of Classification Search
CPC .... F03C 1/0639; F03C 1/0694; F03C 1/0636; F03C 1/0652; F03C 1/0668; F04B 1/328;
(Continued)

(56) References Cited

U.S. PATENT DOCUMENTS 9,963,967 B2 * 5/2018 Bergmann ..... F01B 3/0032
2005/0017573 A1 * 1/2005 Achten ..... F01B 3/0038 303/1

(Continued)

FOREIGN PATENT DOCUMENTS

WO 03058035 A1 7/2003
WO 2013087666 A1 6/2013

OTHER PUBLICATIONS

Italian Search Report and Written Opinion dated Jun. 8, 2016 for Application No. ITUB20155999.

*Primary Examiner* — Devon C Kramer
*Assistant Examiner* — David N Brandt
(74) *Attorney, Agent, or Firm* — Patterson + Sheridan, LLP

(57) ABSTRACT

A hydraulic machine comprising: an outer casing comprising a first front plate and a second front plate, a shaft rotatable about a main axis, a first rotor comprising a first rotor body rotatable with said shaft around said main axis, and a plurality of first pistons with respective spherical ring heads fixed to said first rotor body, a second rotor comprising a second rotor body and a plurality of second pistons with respective spherical ring heads, wherein the second rotor is rotatable about a secondary axis, inclined with respect to said main axis, a plurality of sleeves that are separate and independent from each other, each having a cylinder open at opposite ends and engaged on opposite sides by a first piston and by a second piston.

13 Claims, 9 Drawing Sheets

(51) Int. Cl.

| | |
|---|---|
| ***F03C 1/40*** | (2006.01) |
| ***F04B 1/12*** | (2006.01) |
| ***F04B 1/20*** | (2006.01) |
| ***F04B 1/22*** | (2006.01) |
| ***F04B 1/32*** | (2006.01) |

(52) U.S. Cl.
CPC ..... *F03C 1/0668* (2013.01); *F03C 1/0694* (2013.01); *F04B 1/124* (2013.01); *F04B 1/20* (2013.01); *F04B 1/2078* (2013.01); *F04B 1/22* (2013.01); *F04B 1/328* (2013.01)

(58) Field of Classification Search
CPC .. F04B 1/20; F04B 1/2078; F04B 1/22; F04B 1/2064; F04B 1/124; F04B 1/12; F04B 1/18; F04B 1/188; F04B 1/32; F04B 1/324; F04B 1/2014; F04B 1/2035; F04B 1/2071; F04B 1/2092; F04B 1/24; F04B 27/0821; F04B 27/0834; F04B 27/0852; F04B 27/086; F04B 27/0808; F04B 27/0813; F04B 3/00; F01B 3/0035; F01B 3/0052; F01B 3/0091
See application file for complete search history.

(56) References Cited

U.S. PATENT DOCUMENTS

| | | | | |
|---|---|---|---|---|
| 2015/0078923 | A1* | 3/2015 | Dantlgraber ..... | F03C 1/0652 417/222.1 |
| 2015/0122115 | A1 | 5/2015 | Herrmann et al. | |

* cited by examiner

HYDRAULIC MACHINE WITH FLOATING CYLINDERS

CROSS-REFERENCE TO RELATED APPLICATIONS

This application claims benefit of Italian patent application number 102015000078409, filed Nov. 30, 2015, which is herein incorporated by reference.

BACKGROUND OF THE INVENTION

Field of the Invention

The present invention relates to hydraulic machines with pistons. More precisely, the invention relates to a hydraulic machine, usable as a pump and as a motor, of the type comprising a first rotor rotatable about a first axis and a second rotor rotatable about a second axis inclined with respect to the first axis.

Description of Prior Art

The document WO03/058035 describes a hydraulic device comprising a casing, a first rotor rotatable about a first axis and carrying a first and a second series of pistons protruding from opposite sides of the first rotor. A second and a third rotor are arranged on opposite sides of the first rotor and are rotatable about their respective axes that are inclined with respect to the rotation axis of the first rotor. The second and the third rotor carry respective arrays of cylinders engaged by respective pistons.

One of the problems of the solution described in the document WO03/058035 is the high number of components and hydraulic sealing zones.

SUMMARY OF THE INVENTION

The present invention aims to provide a hydraulic machine having, in the same displacement, smaller overall dimensions compared to the known solutions, and having a smaller number of components and hydraulic sealing zones.

According to the present invention, this object is achieved by a hydraulic machine having the characteristics forming the subject of claim 1.

Preferred embodiments of the invention form the subject of the dependent claims.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
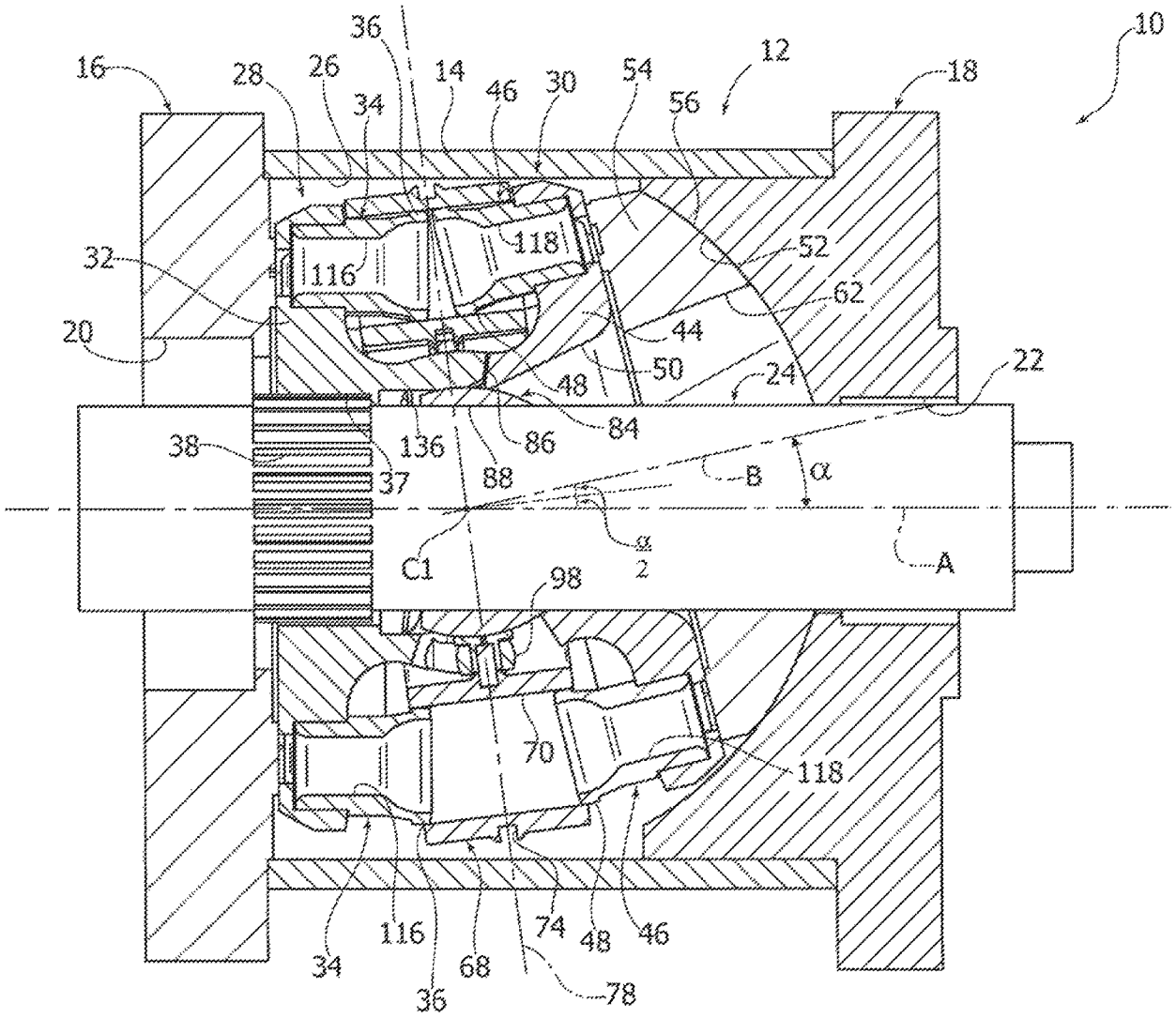
FIG. 1 is an axial cross-section of a hydraulic machine according to the present invention.
Figure 2:
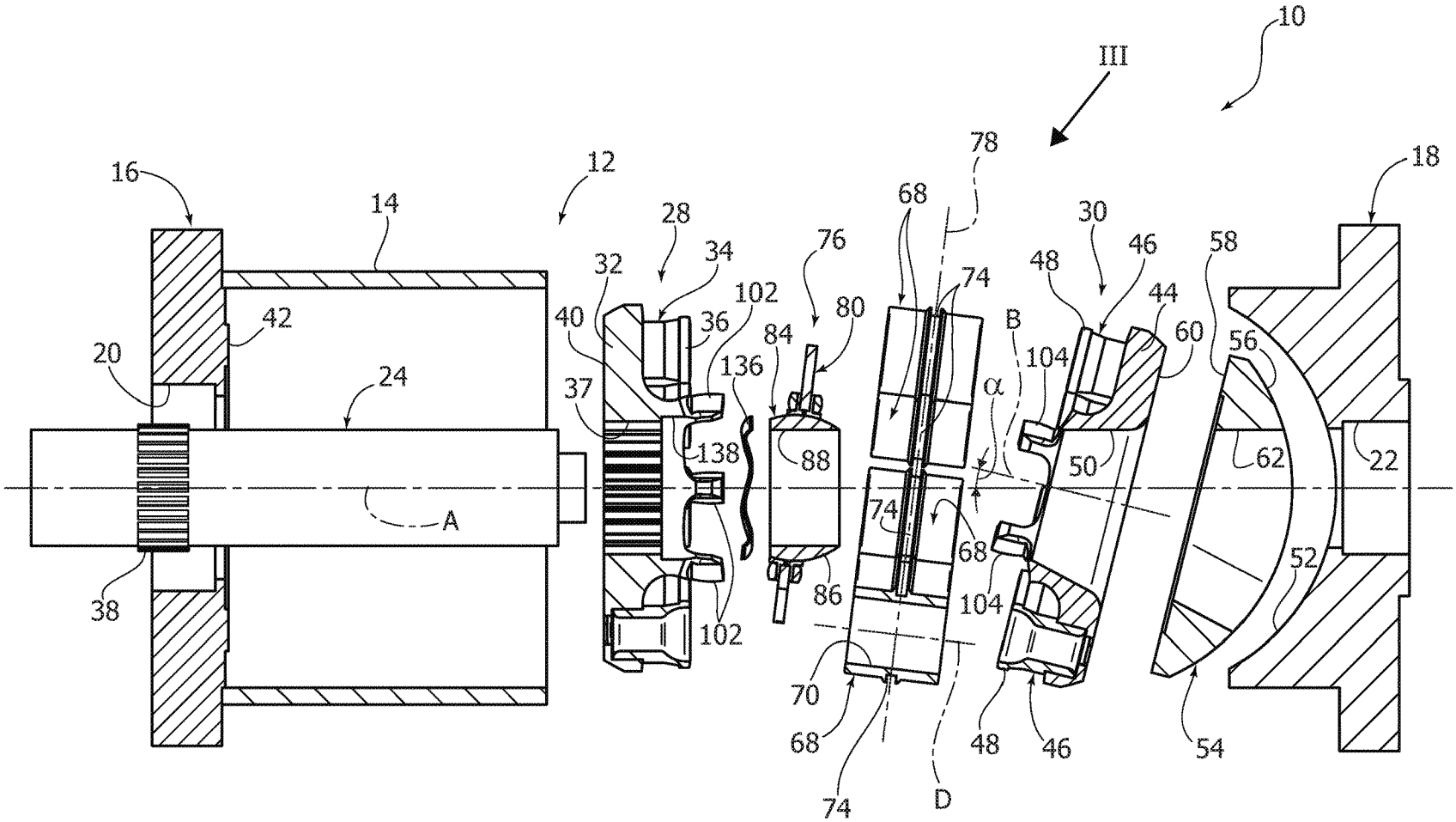
FIG. 2 is an exploded axial cross-section of the hydraulic machine of FIG. 1.

With reference to FIGS. 1 and 2, numeral 10 indicates a hydraulic machine according to the present invention. The hydraulic machine 10 can operate either as a pump or as a motor. The hydraulic machine 10 comprises a stationary casing 12 comprising a tubular central body 14, a first front plate 16 and a second front plate 18. The first and the second front plates 16, 18 are fixed to opposite ends of the central body 14. The first and the second front plates 16, 18 are provided with respective seats 20, 22 for bearings and seals (not shown), which support in rotation a shaft 24 rotatable with respect to the casing 12 about a main axis A.

The casing 12 defines a chamber 26 within which a first rotor 28 and a second rotor 30 are arranged.

The first rotor 28 comprises a first rotor body 32 and a plurality of first pistons 34 fixed to the first rotor body 32. The first rotor body 32 has a splined hole 37 that engages a splined portion 38 of the shaft 24. Thus, the first rotor 28 is rotationally fixed with respect to the shaft 24.

The first pistons 34 are fixed cantilevered to the first rotor body 32 and have respective longitudinal axes parallel to the main axis A. The first pistons 34 have respective spherical ring heads 36 that are distal with respect to the first rotor body 32. The first rotor body 32 has a radial support surface 40, which rests with hydraulic sealing contact against a corresponding support surface 42 of the first front plate 16. During operation, the radial support surface 40 of the first rotor body 32 rotates in contact with the support surface 42 of the first front plate 16.

The second rotor 30 comprises a second rotor body 44 and a plurality of second pistons 46. The second pistons 46 are fixed to the second rotor body 44. The second pistons 46 protrude cantilevered from the second rotor body 44 and have respective spherical ring heads 48 that are distal with respect to the second rotor body 44. From a constructive point of view, the second pistons 46 can be identical to the first pistons 34.

The second rotor body 44 has a central opening 50 through which the shaft 24 extends. The central opening 50 of the second rotor body 44 has dimensions that are substantially greater than the diameter of the shaft 24. The central opening 50 of the second rotor body 44 is sized so as to allow the second rotor 30 to rotate about a secondary axis B, which is inclined with respect to the main axis A by an angle variable between a minimum value equal to 0° (condition in which the secondary axis B is aligned with the main axis A), a positive maximum angle indicated by $\alpha$ in FIGS. 1 and 2, and a maximum negative angle equal to $-\alpha$.

The second front plate 18 has a concave semi-cylindrical seat 52 with an axis orthogonal to the main axis A. An adjustment plate 54 is arranged between the second rotor body 44 and the second front plate 18. The adjustment plate 54 has a semi-cylindrical convex surface 56, which engages the semi-cylindrical concave seat 52 of the second front plate 18, in an oscillating manner with hydraulic sealing contact. The adjustment plate 54 has a support surface 58 against which a corresponding support surface 60 of the second rotor body 44 rests, with hydraulic sealing contact. The adjustment plate 54 has a central opening 62 crossed by the shaft 24. The central opening 62 has dimensions that are substantially greater than the diameter of the shaft 24, so as to allow the adjustment plate 54 to assume a plurality of inclined positions with respect to the main axis A.

During operation, at constant displacement, the adjustment plate 54 is in a fixed position with respect to the second front plate 18. The second rotor 30 is pressed against the adjustment plate 54 and the adjustment plate 54 is pressed against the seat 52, so that the support surfaces 58, 60 and 56, 52 are consistently in contact with each other with hydraulic sealing contact. The angular position of the adjustment plate 54 with respect to the second front plate 18 determines the angle α between the secondary rotation axis B of the second rotor 30 and the main axis A.

Figure 9:
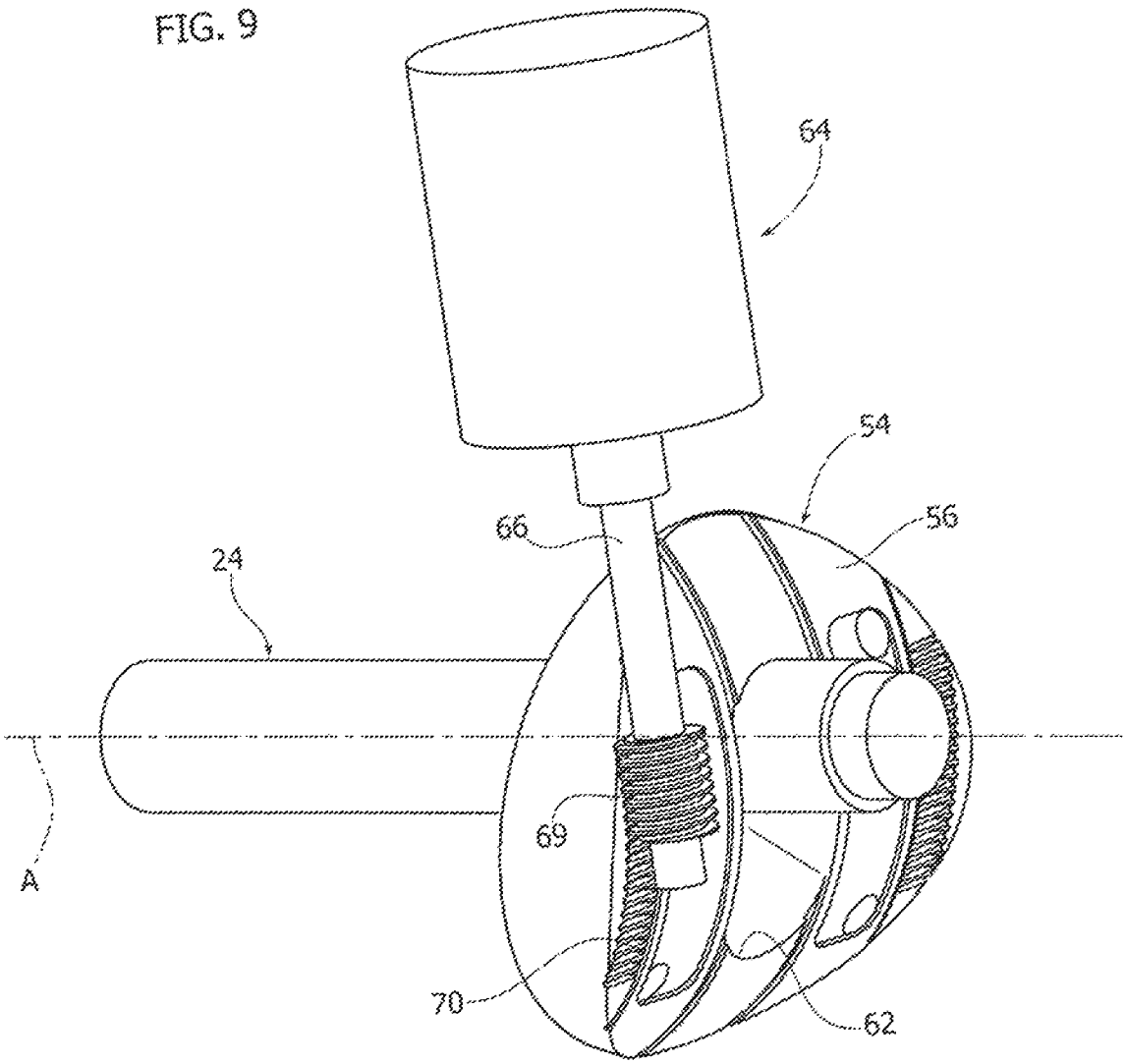
FIG. 9 is a perspective view illustrating a possible adjustment device of the displacement of the machine according to the invention.

With reference to FIG. 9, according to a non-exclusive embodiment, the adjustment plate 54 is associated with an actuator 64 that adjusts the angular position of the adjustment plate 54 with respect to the second front plate 18. In the example illustrated in FIG. 9, the actuator 64 is a rotary actuator, which drives a shaft 66 into rotation, on which a screw 69, which cooperates with a toothed portion 70 provided on the adjustment plate 54, is fixed. The actuator 64 controls an oscillation of the adjustment plate 54 about an axis orthogonal to the main axis A. Since the second rotor 30 is constrained to remain in contact with the support surface 58 of the adjustment plate 54, the movement of oscillation of the adjustment plate 54 controls an adjustment of the angle α between the rotation axis B of the second rotor 30 with respect to the main axis A.

Figure 3:
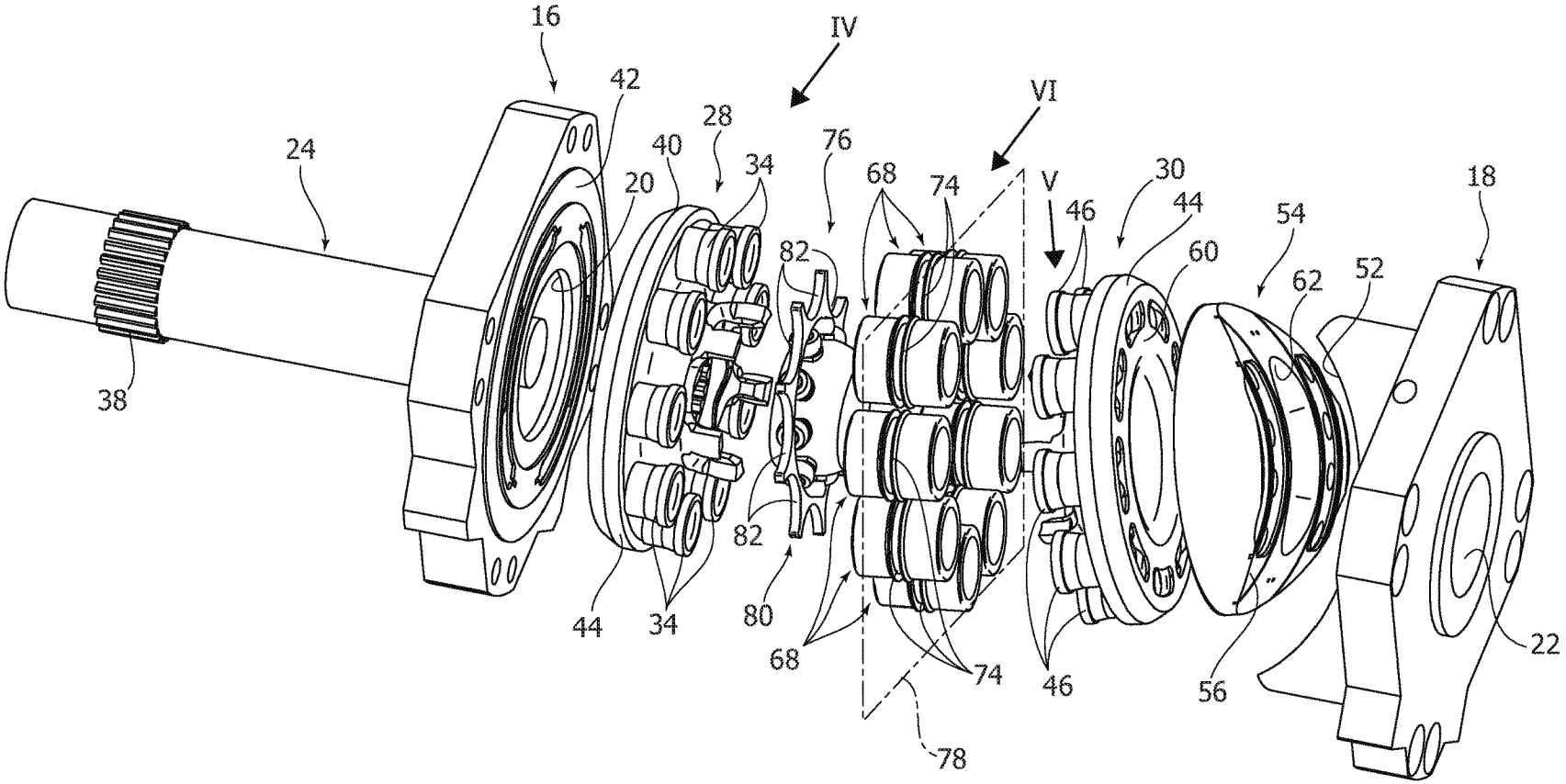
FIG. 3 is an exploded perspective view of the components indicated by the arrow III in FIG. 2.
Figure 4:
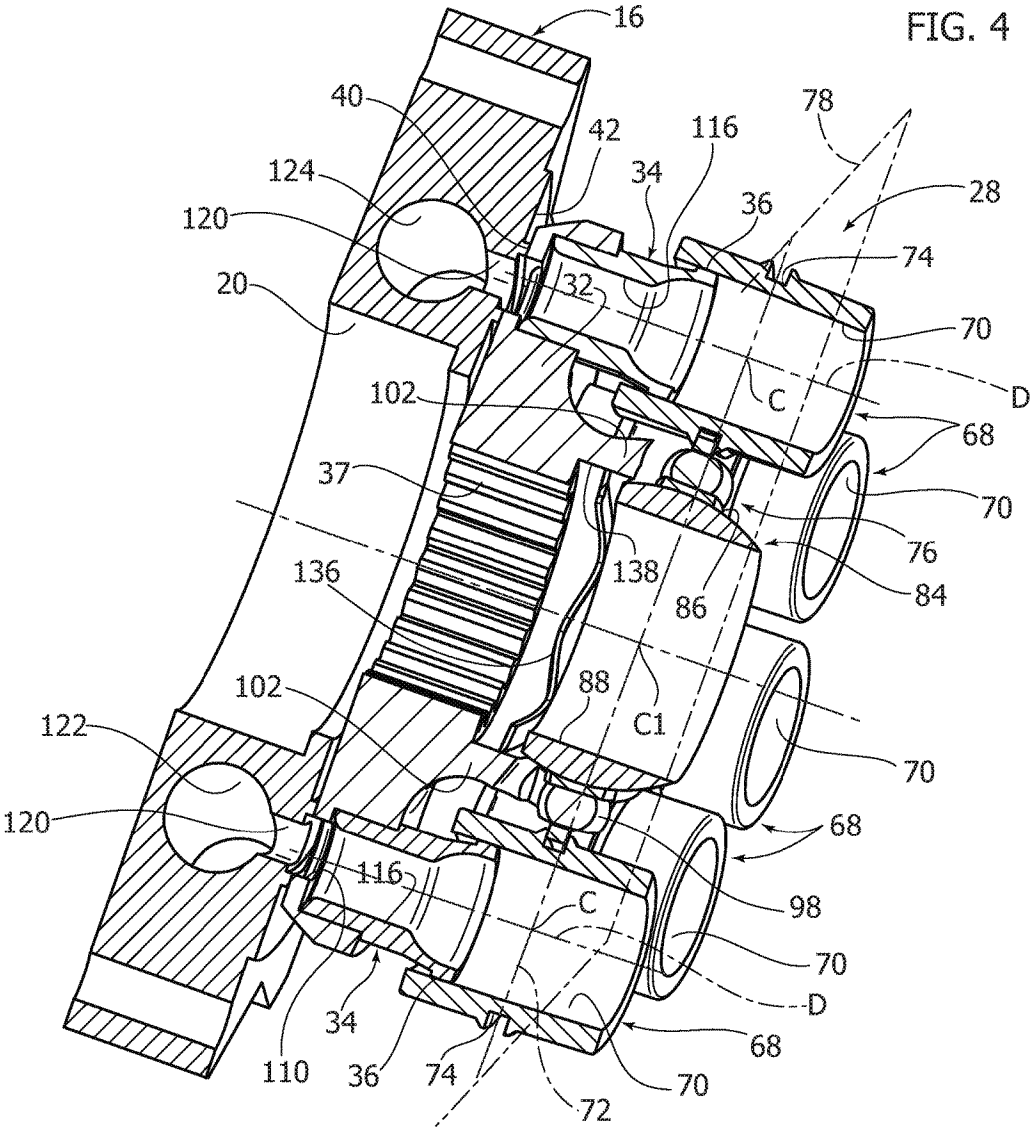
FIG. 4 is a perspective view in cross-section of the part indicated by the arrow IV in FIG. 3.

With reference to FIGS. 3 and 4, the machine 10 comprises a plurality of sleeves 68 that are separate and independent from each other. Each sleeve has a respective cylinder 70 open at both ends. Each cylinder 70 is engaged on opposite sides by a respective first piston 34 and by a respective second piston 46. The spherical heads 36, 48 of the pistons 34, 46 establish a hydraulic sealing contact with the walls of the respective cylinder 70.

With particular reference to FIG. 4, each sleeve 68 has a respective transverse plane of symmetry 72, defined as the plane of symmetry of the cylinder 70 orthogonal to the longitudinal axis D of the cylinder 70. On its outer surface, each sleeve 68 has an annular groove 74 that is coaxial to the longitudinal axis D of the cylinder 70 and symmetrical with respect to the central transverse plane 72.

Figure 6:
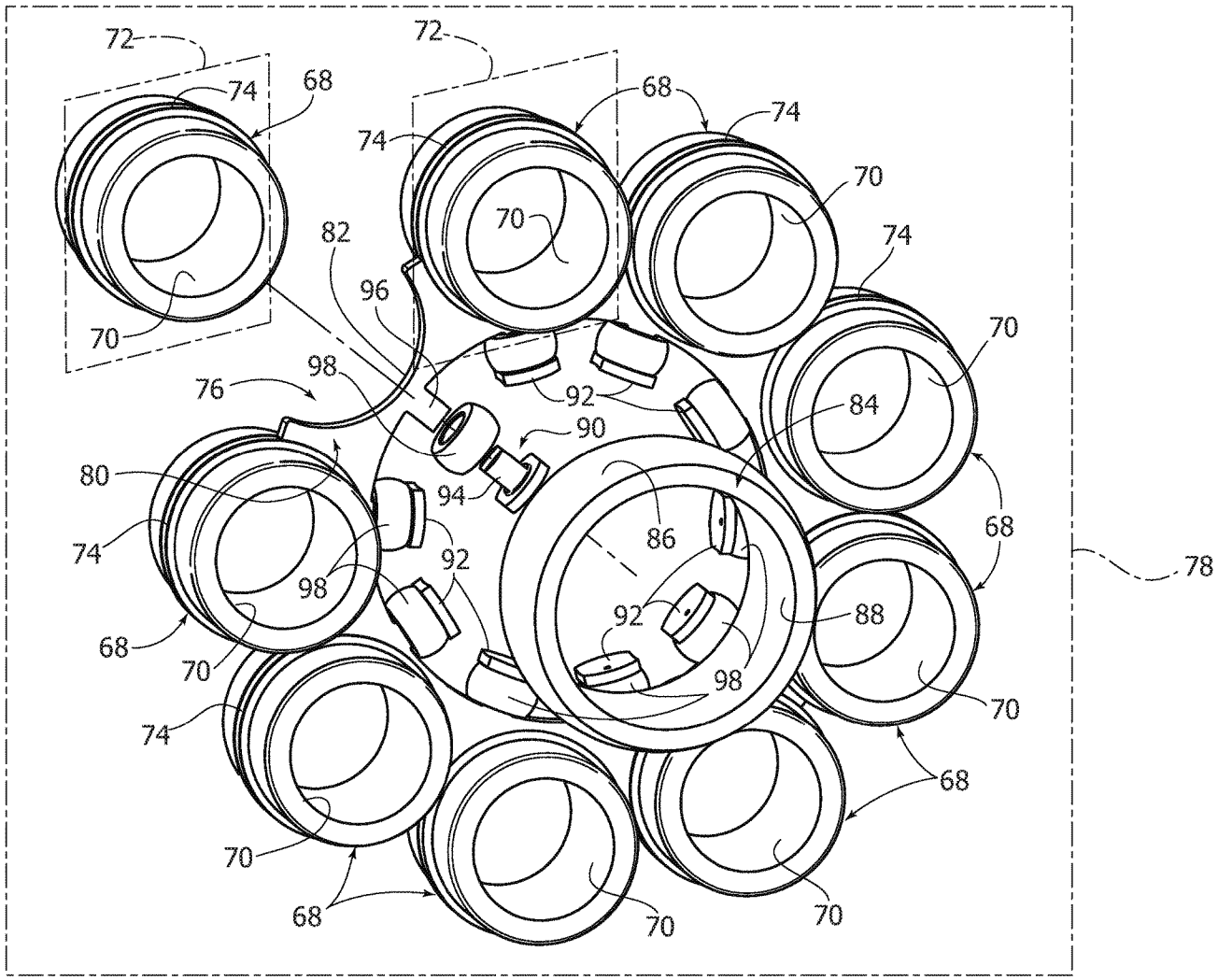
FIG. 6 is an exploded perspective view of the part indicated by the arrow VI in FIG. 3.

With reference to FIGS. 2, 4 and 6, the machine 10 comprises a guiding device 76 associated with the sleeves 68. The guiding device 76 engages the sleeves 68 in a floating manner, and constrains the sleeves 68 so that the central transverse planes 72 of the individual sleeves 68 are consistently contained in a common reference plane 78. As shown in FIG. 1, a straight line perpendicular to the common reference plane 78 is inclined by an angle of between 0 and α, preferably equal to α/2, with respect to the rotation axis A of the first rotor 28 and to the rotation axis B of the second rotor 30. As shown in FIG. 6, the guiding device 76 comprises a guide plate 80 having a plurality of semicircular seats 82 that engage respective grooves 74 of the sleeves 68. The semi-circular grooves 82 of the guide plate 80 have a radius greater than the radius of the annular grooves 74 of the sleeves 68. The thickness of the semi-circular grooves 82 is essentially equal to the thickness of the annular grooves 74 of the sleeves 68. The sleeves 68 engage the respective semi-circular grooves 82 in a simple support relation. The sleeves 68 are free to float with respect to the guide plate 80, while maintaining the engagement between the semi-circular grooves 82 and the annular grooves 74. In this way, the central transverse planes 72 of the individual sleeves 68 are constrained to remain coplanar with each other and contained in the common reference plane 78, which coincides with the central plane of the guide plate 80.

The guiding device 76 comprises an abutment ring 84 having a convex spherical surface 86 and a central hole 88, which engages the shaft 24 in a freely rotatable manner. The abutment ring 84 is arranged on the shaft 24 between the first rotor 28 and the second rotor 30. The center C1 of the spherical surface 86 is positioned on the main axis A.

With particular reference to FIG. 6, the guiding device 76 comprises a plurality of feet 90 having respective concave spherical surfaces 92, which rest on the convex spherical surface 86 of the abutment ring 84. The radii of curvature of the concave spherical surfaces 92 are equal to the radius of curvature of the convex spherical surface 86 of the support ring 84. The feet 90 have respective stems 94 provided with respective fork-shaped seats, into which respective radial teeth 96 are inserted, with a rectangular transverse cross-section, protruding from the radially inner part of the guide plate 80. On the stems 94 of the feet 90 respective rolling bodies 98 are rotatably mounted with preferably spherical outer surfaces of revolution. As shown in FIG. 4, the feet 90 restrain the guide plate 76 relative to the abutment ring 84 so that the common reference plane 78 (coinciding with the central plane of the guide plate 80) passes continuously through the center C1 of the spherical surface 86. The common reference plane 78 also passes through the centers C of all the cylinders 70, as indicated in FIG. 4 The abutment ring 84, the center C1 of which defines the position of the common reference plane 78, is constrained between the first rotor 28 and the second rotor 30 in the manner that will be described below.

Figure 7:
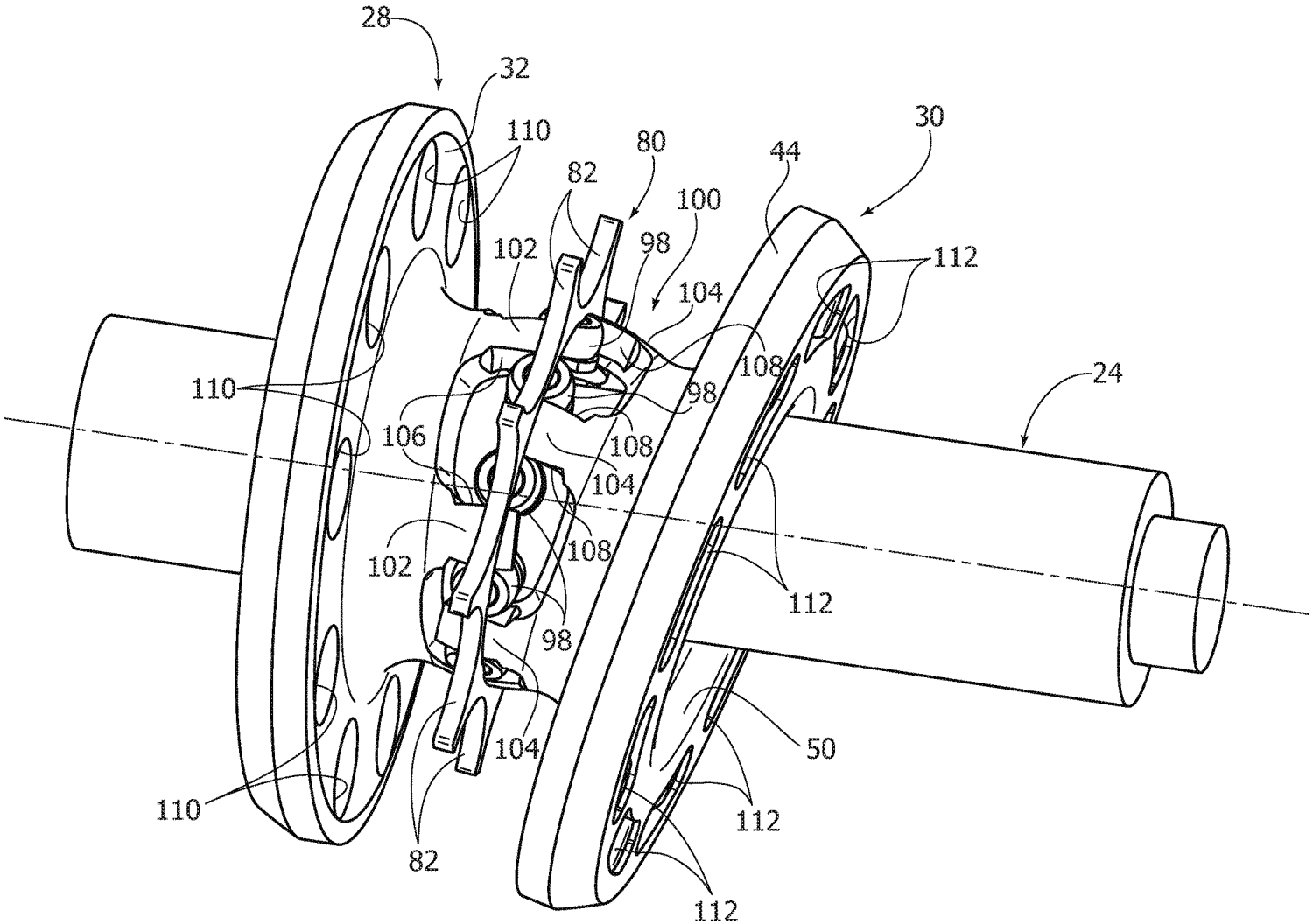
FIG. 7 is a perspective view illustrating a constant-velocity joint arranged between the first and the second rotor of the hydraulic machine according to the invention.

With reference to FIG. 7, the hydraulic machine 10 comprises a constant-velocity device 100 that interconnects the first rotor 28 and the second rotor 30. The constant-velocity device 100 comprises a first series of front teeth 102 fixed or integral with the first rotor body 28 and a second series of front teeth 104 fixed or integral with the second rotor body 44. The front teeth 102, 104 have respective sides 106, 108 with cylindrical surfaces that are in contact with the outer surfaces of the rolling bodies 98. Each rolling body 98 is retained between a side 106 of a front tooth 102 of the first rotor 28 and a side 108 of a front tooth 104 of the second rotor 30. Each front tooth 102, 104 is arranged between two adjacent rolling bodies 98. The radii of curvature of the cylindrical surfaces of the sides 106, 108 are equal to the radius of the outer surfaces of the rolling bodies 98. This arrangement produces a constant-velocity transmission between the first rotor 28 and the second rotor 30, which ensures that the angular speeds of the two rotors 28, 30 about the respective axes A and B are consistently identical to each other.

Figure 5:
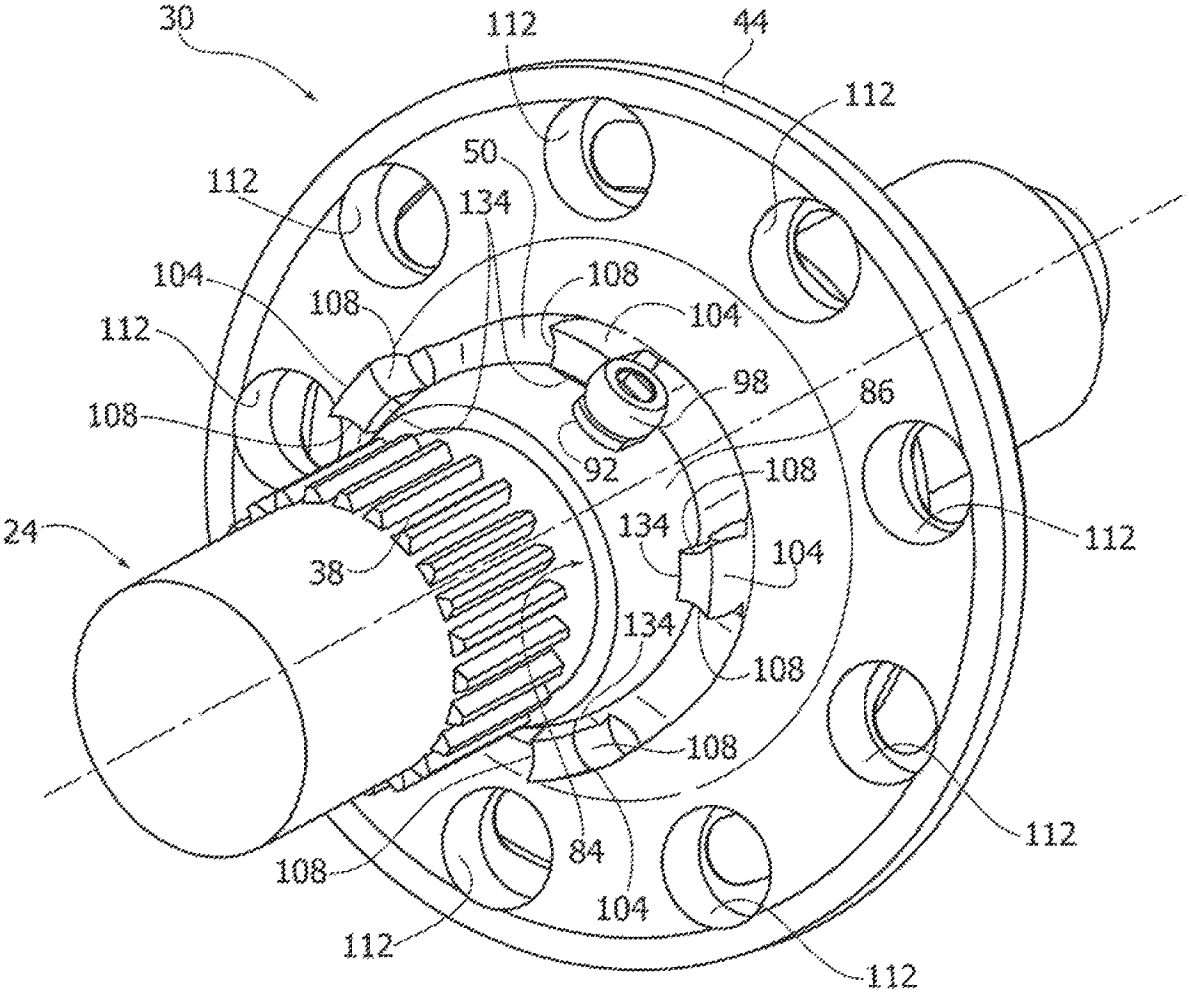
FIG. 5 is a perspective view of the part indicated by the arrow V in FIG. 3, with some components removed.

With reference to FIG. 5, the front teeth 104 of the second rotor body 44 have inner surfaces 134 with a concave spherical shape that are pressed into contact against the convex spherical surface 86 of the abutment ring 84. With reference to FIG. 4, an elastic element in compression 136 is arranged between the abutment ring 84 and the first rotor body 32. The elastic element 136 can be composed of a wave spring as shown in FIG. 4 or, alternatively, by a helical spring or any other elastic element suitable for applying an axial force between the first rotor body 32 and the abutment ring 84. The elastic element 136 is housed in a seat 138 of the first rotor body 32 located internally with respect to the front teeth 102. The elastic element 136 applies an elastic force on the abutment ring 84 in the main axis direction A and presses the spherical surface 86 of the abutment ring 84 into contact against the spherical surfaces 134 of the second rotor body 44. The elastic force produced by the elastic element 136 in the absence of hydraulic pressure in the cylinders 70 creates the contact force necessary to ensure the hydraulic sealing between the first rotor 28 and the first front plate 16 and between the second rotor 30, the adjustment plate 54 and the second front plate 18.

Figure 8:
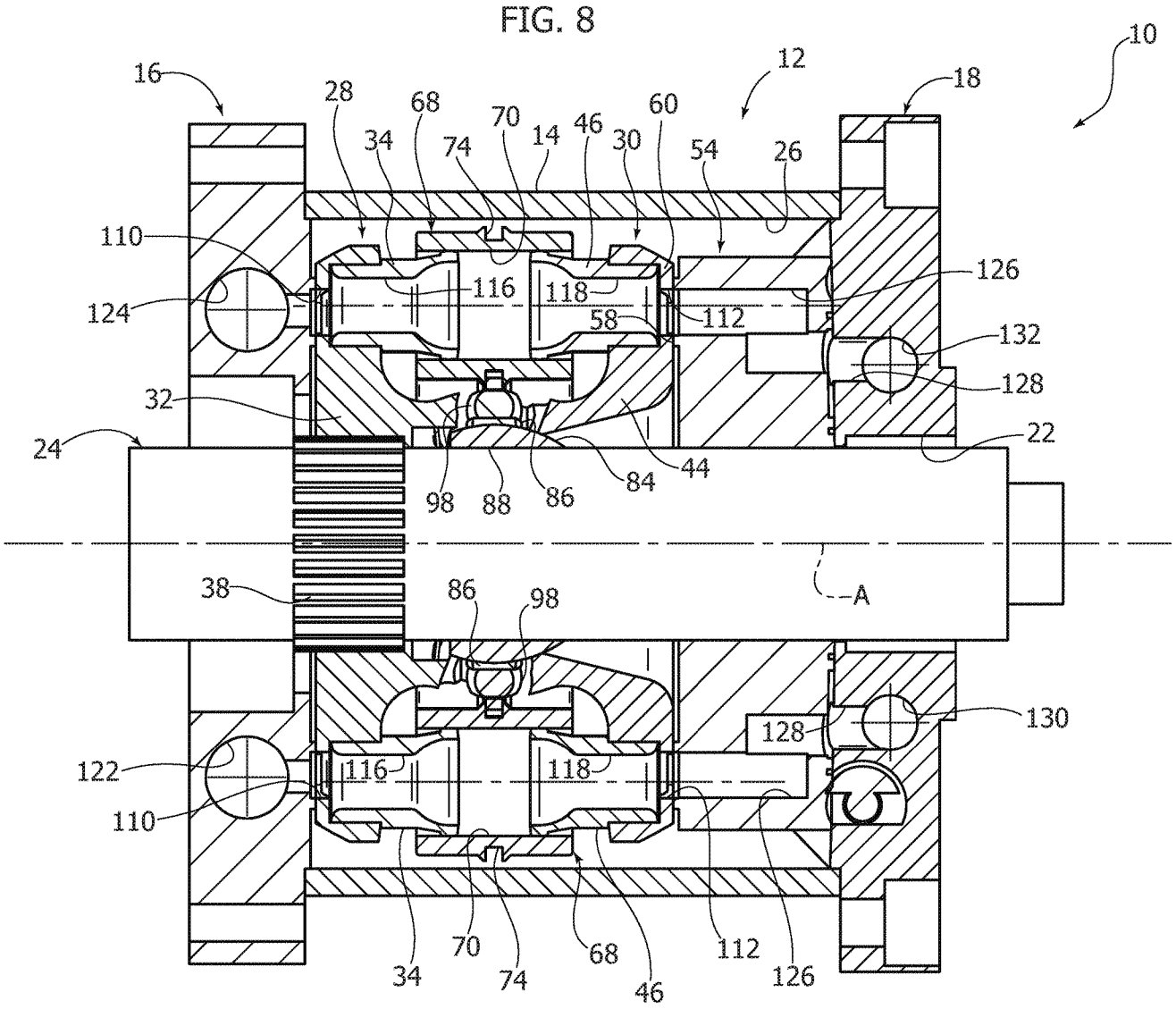
FIG. 8 is an axial cross-section illustrating the hydraulic connections in the machine according to the invention.

With reference to FIGS. 4, 5 and 7, the first rotor body 32 is equipped with first openings 110 within which the root portions of respective first pistons 34 (see FIG. 1) are fixed. Similarly, as shown in FIGS. 5 and 7, the second rotor body 44 is equipped with second openings 112 within which the root portions of respective second pistons 46 (see FIG. 8) are fixed. As shown in FIGS. 1 and 8, the first and the second pistons 34, 46 are provided with respective apertures 116, 118, which connect the respective openings 110, 112 (see FIGS. 7 and 8) with the respective cylinder 70. With reference to FIG. 4, the first openings 110 of the first rotor body 32 are cyclically in communication with ports 120 formed in the support surface 42 of the first front plate 16. The ports 120 are connected to inlet/outlet hydraulic fluid conduits 122, 124. With reference to FIG. 8, the openings 112 of the second rotor body 44 are cyclically in fluid communication with through-openings 126 formed in the adjustment plate 54. The through-openings 126 are, in turn, in fluid communication with ports 128 formed in the second front plate 18 and in fluid communication with inlet/outlet fluid conduits 130, 132.

In an alternative embodiment, inlet/outlet conduits 122, 124 could be provided only in the first front plate 16. In this case the second front plate 18 would be devoid of hydraulic conduits 130, 132. In this case, the apertures 118 of the second pistons 46 could be partially filled by closing elements inserted into the apertures 118, so as to limit the volume of oil within the cylinders 70. The through-openings 126 leave free the connection for the compensation of the forces.

The hydraulic machine 10 can operate indifferently as a hydraulic pump or a hydraulic motor. In both modes of operation, the angle of inclination $\alpha$ of the adjustment plate 54 determines the working displacement of the machine. The working displacement is zero when the angle $\alpha$ between the secondary rotation axis B and the main rotation axis A is zero (condition in which the two axes are coincident). The working displacement is maximum when the angle $\alpha$ between the rotation axes B and A is equal to the maximum working angle. The machine displacement can be varied continuously between the maximum negative value and the maximum positive value by varying the inclination angle of the adjustment plate 54 from $-\alpha$ to $+\alpha$ by means of the actuator 64.

In any position in which the angle $\alpha$ is different from zero, the rotation of the rotors 28, 30 about the respective rotation axes A, B produces an alternate movement of the pistons 34, 46 within respective cylinders 70 between a spaced-apart position and a close-together position. This movement cyclically varies the volume of the cylinders between the two pistons 34, 46. The cyclical variations of the volumes of the cylinders 70 produce flow in the case of operation as a pump, or a working torque in the case of operating as a motor.

Of course, without prejudice to the principle of the invention, the details of construction and the embodiments can be widely varied with respect to those described and illustrated, without thereby departing from the scope of the invention as defined by the claims that follow.

The invention claimed is:

1. A hydraulic machine comprising:

an outer casing comprising a first front plate and a second front plate;

a shaft rotatably supported by the first and second front plates around a main axis;

a first rotor comprising a first rotor body rotatable with the shaft about the main axis, and a plurality of first pistons with respective spherical ring heads, fixed to the first rotor body;

a second rotor comprising a second rotor body and a plurality of second pistons with respective spherical ring heads, wherein the second rotor is rotatable about a secondary axis, inclined with respect to the main axis;

a plurality of sleeves that are separate and independent from each other, each having a cylinder open at opposite ends and engaged on opposite sides by a first piston and by a second piston, with spherical ring heads of the first and of the second piston in hydraulic sealing contact with the cylinder, wherein the spherical ring heads of the first and of the second piston are free to move axially into the respective cylinder, and wherein each sleeve has a respective transverse symmetry plane orthogonal with respect to the longitudinal axis of the cylinder; and a guide that engages the sleeves in a floating manner and constrains the sleeves so that the transverse symmetry planes of the individual sleeves are consistently contained in a common reference plane, the guide comprising a guide plate having a plurality of semicircular seats which engage respective annular grooves formed on outer surfaces of the sleeves, the annular grooves being coaxial to the longitudinal axes of the sleeves and symmetrical with respect to the respective transverse symmetry planes.

2. A machine according to claim 1 , wherein the guide comprises an abutment ring coaxial with the shaft and arranged between the first rotor and the second rotor, the abutment ring having a convex spherical outer surface on which respective support feet abut, provided with stems that engage respective radial teeth with rectangular cross-section of the guide plate.

3. A machine according to claim 2, wherein the second rotor body is provided with concave spherical surfaces abutting on the convex spherical surface of the abutment ring.

4. A machine according to claim 3, wherein an elastic element in compression is arranged between the abutment ring and the first rotor body.

5. A machine according to claim 1, wherein the second rotor body rests against an adjustment plate housed in a cylindrical seat of the second front plate and associated with an actuator configured to vary the angle of the secondary rotation axis of the second rotor.

6. A machine according to claim 2, wherein the first and the second rotor are connected for rotation to each other by means of a constant-velocity device comprising a first set of front teeth carried by the first rotor body and a second set of front teeth carried by the second rotor body, the first and the second front teeth having respective sides, which cooperate with rolling bodies.

7. A machine according to claim 6, wherein the rolling bodies are rotatably mounted on respective stems of the feet of the guide.

8. A machine according to claim 1, wherein the first pistons have respective apertures, which connect the cylinders with openings of the first rotor body, which enter cyclically into fluid communication with ports of the first front plate communicating with inlet/outlet hydraulic fluid conduits.

9. A machine according to claim 1, wherein the second pistons have respective openings, which connect the cylinders with openings of the second rotor body, which enter cyclically into fluid communication with through-openings formed in an adjustment plate, in turn arranged in fluid communication with ports of the second front plate communicating with inlet/outlet hydraulic fluid conduits.

10. A machine according to claim 2, wherein the feet constrain the guide plate relative to the abutment ring so that the common reference plane consistently passes through the center of the convex spherical surface of the abutment ring and through the centers of the cylinders, wherein the abutment ring is constrained between the first rotor and the second rotor.

11. A machine according to claim 2, wherein the feet constrain the guide plate with respect to the abutment ring so that the common reference plane is coincident with the central plane of the guide plate.

12. A machine according to claim 1, wherein a straight line perpendicular to the common reference plane is inclined with respect to the rotation axis of the first rotor and to the rotation axis of the second rotor by an angle equal to half the angle between the rotation axis of the first rotor and the rotation axis of the second rotor.

13. A hydraulic machine comprising:

an outer casing comprising a first front plate and a second front plate;

a shaft rotatably supported by the first and second front plates around a main axis;

a first rotor comprising a first rotor body rotatable with the shaft about the main axis, and a plurality of first pistons with respective spherical ring heads, fixed to the first rotor body;

a second rotor comprising a second rotor body and a plurality of second pistons with respective spherical ring heads, wherein the second rotor is rotatable about a secondary axis, inclined with respect to the main axis;

a plurality of sleeves that are separate and independent from each other, each having a cylinder open at opposite ends and engaged on opposite sides by a first piston and by a second piston, with spherical ring heads of the first and of the second piston in hydraulic sealing contact with the cylinder, wherein the spherical ring heads of the first and of the second piston are free to move axially into the respective cylinder, and wherein each sleeve has a respective transverse symmetry plane orthogonal with respect to the longitudinal axis of the cylinder; and a guide that engages the sleeves in a floating manner and constrains the sleeves so that the transverse symmetry planes of the individual sleeves are consistently contained in a common reference plane, wherein the second pistons have respective openings, which connect the cylinders with openings of the second rotor body, which enter cyclically into fluid communication with through-openings formed in an adjustment plate, in turn arranged in fluid communication with ports of the second front plate communicating with inlet/outlet hydraulic fluid conduits.

* * * * *